US006184198B1

(12) United States Patent
Siamon

(10) Patent No.: US 6,184,198 B1
(45) Date of Patent: Feb. 6, 2001

(54) CLEANING SOLUTION

(76) Inventor: Al Siamon, 175 Riverbank La., Paso Robles, CA (US) 93446

( * ) Notice: Under 35 U.S.C. 154(b), the term of this patent shall be extended for 0 days.

(21) Appl. No.: 09/098,042

(22) Filed: Jun. 16, 1998

(51) Int. Cl.[7] ..... C11D 3/06; C11D 3/10
(52) U.S. Cl. ..... 510/510
(58) Field of Search ..... 510/405, 509, 510/510

(56) References Cited

U.S. PATENT DOCUMENTS

| | | | | |
|---|---|---|---|---|
| 3,996,149 | * | 12/1976 | Burke, Jr. | 252/160 |
| 4,115,307 | | 9/1978 | McGilvery | 252/135 |
| 4,212,761 | * | 7/1980 | Ciaccio | 252/174.12 |
| 4,504,995 | | 3/1985 | Zippwald, Sr. | 15/102 |
| 4,540,504 | * | 9/1985 | Eoga | 252/99 |
| 4,592,892 | * | 6/1986 | Ueno et al. | 422/28 |
| 4,740,366 | | 4/1988 | Winston et al. | 424/45 |
| 4,828,621 | | 5/1989 | Siamon | 106/271 |
| 4,851,212 | | 7/1989 | Winston et al. | 424/45 |
| 5,552,078 | | 9/1996 | Carr et al. | 510/351 |

* cited by examiner

*Primary Examiner*—John Hardee
(74) *Attorney, Agent, or Firm*—Skjerven Morrill MacPherson LLP; Norman R. Klivans

(57) ABSTRACT

A cleaning solution formulation consisting of sodium bicarbonate, sodium carbonate and trisodium phosphate in aqueous solution is presented. Methods of the present invention provide for cleaning a wide variety of surfaces and materials with the cleaning solution of the present invention. In addition, the cleaning solution of the present invention also provides for the elimination or reduction of malodors and prevents the growth of various micro-organisms by and through its action to form a thin encapsulating film.

6 Claims, No Drawings

CLEANING SOLUTION

CROSS-REFERENCE TO RELATED APPLICATIONS

A related application, entitled "SYSTEMS AND METHODS FOR CLEANING", by the inventor of the present application, U.S. patent application Ser. No. 09/098,170, filed Jun. 16, 1998, is filed concurrently herewith.

BACKGROUND

1. Field of the Invention

The present invention relates to cleaning and more particularly, to a cleaning solution and uses thereof.

2. Description of Related Art

The formulation of cleaning solutions that have the ability to clean a large variety of soils, stains and contaminants from a wide variety of surfaces and materials is of significant importance. To this effect, much research in the fields of cleaning agents has been performed and has resulted in a plethora of cleaning solutions having a wide variety of cleaning formulations. To further enhance the properties of these many cleaning formulations components including a wide variety of surfactants, anti-soil and anti-stain agents and the like are also typically included in the final formulations. In addition, cleaning solution formulations have been recently introduced that also provide anti-bacterial properties by virtue of the presence of still other components added to the already complex formulations.

However, while many of these complex compositions provide acceptable cleaning properties, these acceptable properties are often limited to a few specific uses. This, despite the many exotic, expensive components employed. Furthermore, as these compositions do not typically eliminate odors, they often contain scent additives that can only serve to cover malodors for a short period of time. Finally, many of these cleaning solutions have components that can be harmful to a user if ingested or brought into contact with a user's skin, thus requiring protective garments to prevent such contact.

Therefore it would be advantageous to have a cleaning solution capable of cleaning a wide variety of surfaces and materials while encompassing only a few readily available components. In addition, it would be advantageous for the cleaning solution to be non-toxic and not be a cause of harm upon casual contact with a user's skin. Additionally, it would be advantageous for the cleaning solution to have sequestering properties with respect to a wide variety of organic materials such as oils and the like to enable the solution to be reused without redeposit of the soils, stains and contaminants removed. It would also be advantageous for the cleaning solution to provide anti-soil and anti-stain properties to the surface or material cleaned by leaving a thin, invisible protective film or coating upon drying. It would further be advantageous for the cleaning solution to eliminate malodors without the need for the addition of scenting agents. Finally, it would be advantageous for the cleaning solution to provide bactericide and fungicide activity.

SUMMARY

In accordance with the present invention, a cleaning solution that provides the above mentioned advantages is provided. The cleaning solution of the present invention consists essentially of a mixture of sodium bicarbonate ($NaHCO_3$, CAS RN 144-55-8), sodium carbonate ($Na_2CO_3$, CAS RN 497-19-8) and trisodium phosphate ($Na_3PO_4$, CAS RN 10101-89-0) formulated as an aqueous solution of those components, in various concentrations. The mixture of sodium bicarbonate, sodium carbonate and trisodium phosphate, present in the above mentioned various concentrations, having a particular molar ratio.

In some embodiments of the present invention the cleaning solution is formulated to be used as a spray cleaner, to be sprayed onto a surface and the wetted surface wiped with a clean cloth to remove soils, stains and contaminants. Advantageously, upon drying, the cleaning solution of the present invention leaves a thin, invisible protective coating or film on the surface. In some such spray embodiments the cleaning solution is sprayed as a very fine mist or aerosol to additionally eliminate malodors from the air.

Advantageously, the thin protective film formed after drying will continue to remove such malodors after the aerosol has dispersed. In addition to eliminating malodors, this thin protective coating or film provides protection against re-soiling, prevents or reduces the rate of bacterial or fungal growth and increases the lubricity of the surface or material, thus reducing wear.

In some embodiments, the cleaning solution of the present invention is formulated to be used for soaking an object to be cleaned, where the solution removes soils, stains and contaminants from the surface of the object and sequesters them preventing redeposition. Such a soaking process is employed as a stand alone cleaning method, for example with agitation as a laundry cleaner, or as a preliminary step with or without agitation, to be followed by another cleaning step. Alternatively, in some embodiments, the cleaning solution is formulated to be employed with scrubbing or brushing where heavy build-ups of soil are present. Also, in some embodiments of the present invention, a combination of one or more of the cleaning methods described is used with one or more of the cleaning solution formulations. Finally, in all of the embodiments of the present invention, the cleaning solution does not require rinsing after use. Thus, the cleaning solution in accordance with the present invention cleans a surface or material and as no rinsing is needed, provides a thin protective film adhered to the surface or material that reduces or prevents re-soiling.

DETAILED DESCRIPTION

The following is a detailed description of illustrative embodiments of the present invention. As these embodiments of the present invention are described, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions are not to be considered in a limiting sense as it is understood that the present invention is in no way limited to the embodiments illustrated.

The present invention provides a cleaning solution for cleaning a wide variety of materials and surfaces. For example, the cleaning solution of the present invention is useful for cleaning painted surfaces such as walls, fabrics such as cotton, wool and synthetic fabrics such as nylon and the like, tile, glass and metal surfaces and various wood and smooth leather surfaces. In addition, the cleaning solution of the present invention provides a thin, invisible protective coating or film to the surfaces, or fibers of the materials, cleaned. This thin protective coating adhers well to most surfaces and is not readily removed by rubbing. Thus the protective coating advantageously prevents or reduces re-soiling or re-staining, increases the lubricity of the surface or material and provides for the removal of malodors from the surrounding environment.

Advantageously, cleaning solutions in accordance with the present invention are formulated using a mixture of three well known, readily available substances, sodium bicarbonate ($NaHCO_3$, CAS RN 144-55-8), sodium carbonate ($Na_2CO_3$, CAS RN 497-19-8) and trisodium phosphate ($Na_3PO_4$, CAS RN 10101-89-0). Each of these substances is essentially non-toxic and otherwise safe. Thus sodium bicarbonate is commonly known as baking powder and is often used as an additive in the preparation of foods as well as a cleaning agent. Sodium carbonate, commonly known as baking soda or sal soda is a well known cleaning additive or enhancer that also has uses, when in solution, as a skin cleanser in eczema. Finally, trisodium phosphate is well known as a water softening agent and as an ingredient in many common detergent formulations.

The cleaning solution encompassed in embodiments of the present invention is believed to gain its advantageous properties by employing a specific molar ratio of the above mentioned components. This specific molar ratio is then formulated in aqueous solutions of varying concentrations. Thus embodiments of the present invention are aqueous solutions having various concentrations of a mixture of sodium bicarbonate (hereafter SB), sodium carbonate (hereafter SC) and trisodium phosphate (hereafter TSP) having a molar ratio of approximately 1:2.6:1.6. That is, for every mole of SB, 2.6 moles of SC and 1.6 moles of TSP are used to prepare the cleaning solutions of the present invention. In a typical "full-strength" formulation, an amount of solution having a first concentration is prepared by combining approximately 910 grams of SB, approximately 1,930 grams of SC and approximately 2,270 grams of TSP in approximately 208 liters of water; the water used is either deionized water, softened water or water processed through a reverse osmosis (RO) system. Such a typical "full-strength" formulation of the first concentration is thus approximately 2.46 percent (%) solids or active ingredients. It will be understood that the quantity of "full-strength" cleaning solution described above is illustrative only and that other quantities having the same molar ratio and percent solids concentration can be readily prepared by one of ordinary skill in the art, for example 100 liters of the "full-strength" cleaning solution rather than 208 liters. In addition, it will be understood that while the specific molar ratio of the above components described has been found to be most effective, other similar molar ratios are also effective. Thus, it has been found that variations of the specific molar ratio of as much as ten percent are still effective and such compositions are within the scope and spirit of the present invention. It has also been found that other solids concentrations for the "full-strength" formulation described above are also effective, for example, concentrations as high as approximately 2.7% or as low as approximately 2.2% are also found to be effective and as such are within the scope and spirit of the present invention.

While "full-strength" formulations are useful as cleaning solutions, other formulations having concentrations less than that of the "full-strength" formulation are also found to be effective cleaners. Thus a formulation having a second concentration is prepared by diluting a "full-strength" solution of the first concentration by approximately one-half. Hence, this "half-strength" formulation has a concentration that is 50% of the first concentration; as a result, such a typical formulation is approximately 1.23% solids. It should be noted that many other dilutions of the "full-strength" cleaning solution can be made and can be advantageously used to clean a wide variety of surfaces and materials; often a particular dilution of the "full-strength" formulation is determined by testing various concentrations to determine a "best" concentration. All of these alternate dilutions are thus also within the scope and spirit of the present invention. For example, a cleaning solution having a 60% concentration (a 40% dilution of the solution having the first concentration) has advantageously been found to be useful for cleaning playing surfaces and surrounds of gaming tables as found in casinos and the like. Such a typical formulation of the third concentration is approximately 1.48% solids. Finally it will be realized that while each of the aforementioned dilutions have been characterized as dilutions of the "full-strength" solution, any could be made directly by mixing together appropriate amounts of SB, SC and TSP in the proper molar ratio of 1:2.6:1.6, respectively.

While as previously mentioned, each of the components of the cleaning solution of the present invention is known, the particular mixture of these components, in accordance with embodiments of the present invention, has not hitherto been known. For example, in U.S. Pat. No. 4,828,621 "COMPOSITION AND METHOD FOR ANTI-STATIC PROTECTION" issued May 9, 1989 to this inventor and now abandoned (hereafter '621), a materially different mixture of the present components was presented. In the '621 patent this materially different mixture formed an anti-static solution having a volume ratio of sodium bicarbonate to sodium carbonate to trisodium phosphate of approximately 1:2:4 in a solution with a solids content of between 4 to 16 percent. Thus, compared to cleaning solutions prepared in accordance with embodiments of the present invention, the anti-static solution of the '621 patent is formulated with a different ratio of components and having a different concentration of solids to produce different results.

In U.S. Pat. No. 5,552,078, "CARBONATE BUILT LAUNDRY DETERGENT COMPOSITION" issued Sep. 3, 1996 to Carr et al. (hereafter '078) the three components of the present invention are taught as part of another materially different formulation. The formulation of the '078 patent having both a different ratio of the three components and a more complex overall formulation with several additional components. Thus, in the '078 patent, a powder composition comprising a surfactant, at least 75 to 80 weight % (wt. %) of sodium carbonate, about 0.1 to 15 wt. % of sodium bicarbonate, about 0.1 to 2 wt. % trisodium phosphate, about 0.1 to 2 wt. % of a polyacrylate or polymaleate and about 1–12 wt. % of water is taught, where this powder composition is primarily used as a laundry detergent. Thus, in addition to the additional materials that the '078 patent teaches are required, the mole ratio of sodium bicarbonate to sodium carbonate to trisodium phosphate is significantly different than that of the present invention.

In some embodiments of the present invention, it has additionally been found advantageous to formulate the present cleaning solution in a particular manner. Thus in some embodiments, the appropriate amount of sodium bicarbonate (SB) is added to deionized, softened or RO water and stirred until dissolved. While SB is known to be quite soluble in water, it has been found to be advantageous to add the SB to water that has been warmed to between 30 to 40 degrees Celsius (° C.) to hasten dissolution. Once the SB is dissolved, the appropriate amount of sodium carbonate (SC) is added to the SB solution, again with stirring. Upon addition of the SC, it will be noted that a hazy solution is obtained, and that even after prolonged stirring, the solution does not become fully clear. Finally the appropriate amount of trisodium phosphate (TSP) is added to the mixture of SB and SC, again with stirring. It will be noted that after addition of the TSP, in a short time (a few minutes) the mixture becomes clear, denoting a true solution of the three components.

One of ordinary skill in the art will realize that other methods of making the cleaning solution of the present invention can be used. For example, the SC can be added to the water as the first step in preparing the cleaning solution. In addition, it is possible to use any one or several of the various hydrated forms of the several components rather than the anhydrous materials specified above. As known, where such hydrated forms are employed, the amount of hydrated material is adjusted to provide the appropriate "anhydrous equivalent weight" to obtain the appropriate molar ratio of approximately 1:2.6:1.6. However, while these other methods of making the cleaning solution are within the scope and spirit of the present invention, the inventor has found it advantageous to prepare the cleaning solution in the manner described above.

In a related application, filed concurrently herewith by the present inventor "SYSTEMS AND METHODS FOR CLEANING", Ser. No. 09/098,170, filed Jun. 16, 1998, systems for cleaning objects, for example stackable objects such as playing cards, chips, coins and tokens, among others are disclosed where each system encompasses the cleaning solution of the present invention. This related application (hereafter M-5191) is incorporated herein by reference in its entirety.

As previously mentioned, in some embodiments in accordance with the present invention, the cleaning solution is formulated to be sprayed onto the surface or material to be cleaned. Thus, as discussed in application Ser. No. 09/,098, 170, a 60% concentration of the cleaning solution is sprayed onto the playing surfaces of a gaming table to lightly wet all the surfaces to be cleaned. Often these playing surfaces, for example as found at "Black Jack" or "Craps" tables are a felt or felt-like material with the appropriate game markings applied to the upper surface. Once the entire surface is made lightly wet, the cleaning solution is then distributed over the surfaces using a clean cloth and any soil or contaminants present are removed with a light rubbing and blotting motion. The surfaces are subsequently allowed to dry and a thin coating or film is formed. This thin film forms on the surface or about the fibers of the material and provides anti-soiling properties as well as increased lubricity to the surface. In addition, the surface of the cleaned material is observed to become softer to the touch and more lubrious than prior to cleaning. Thus, longer time periods between cleanings and decreased surface wear advantageously result.

The cleaning solution of the present invention is useful for cleaning a wide variety of surfaces using the spay method described above. Thus in addition to playing surfaces of gaming tables, the cleaning solution can be employed as a spray to clean carpets and rugs, counter tops made of tile or other natural surfaces, artificial surfaces such as Formica® or corian®, metal surfaces such as stainless steel, glass surfaces and surfaces painted with water or oil based paints such as latex or enamel. In some cases the cleaning solution is sprayed onto the surface to be cleaned and then the surface wiped clean of soils and contaminants with a clean dry cloth or the like. In other cases the cleaning solution is applied to a cloth or other applicator and the dampened applicator used to wipe the surface clean of soils and contaminants. After cleaning a surface with the cleaning solution of the present invention, it will be observed that the cleaned surface acquires a smooth, lubrious feel that will be resistant to re-soiling. Such a smooth feel is similar to that observed for a surface painted with a high gloss finish paint.

It should be noted that while the "full strength" solution is typically compatible with most materials and surfaces, it may be advantageous to use a more dilute solution for some materials. For example, the playing surfaces of most gaming tables are most appropriately cleaning using the 60% concentration and most playing cards are most appropriately cleaned using a 50% concentration of cleaning solution. Thus as for most general purpose cleaning formulations, it is advisable to test a portion of the surface to be cleaned prior to general cleaning to ensure that a proper dilution of the cleaning solution is used. Such pre-testing is well known.

The cleaning solution of the present invention can also be employed as a pre-soak bath for heavily soiled or contaminated objects or materials. Thus, an appropriate amount of the cleaning solution of the present invention is placed in a container and the items to be soaked are added. The dilution of cleaning solution employed as well as the soak time are a function of the amount of soil and the specific material. However, it has been found that for most applications a soak time of between 5 to 30 minutes is appropriate. For example, a heavily soiled clothing article or garment can be pre-soaked in a 50% dilution of the cleaning solution of the present invention prior to washing. In this manner, most if not all of the soil is removed and a standard washing cycle can be employed to result in a stain-free garment. In embodiments where the amount of soil is less, it has been found advantageous to use a 60% concentration of the cleaning solution to merely pre-wet soiled area prior to a standard washing.

Where there is heavy soil or contamination on a surface that has ridges, grooves or other indentaions or surface irregularities, is has been found advantageous to employ a combination of pre-soaking and scrubbing to remove soil. Thus as mentioned in M-5191, heavily soiled casino chips are first soaked in "full-strength" solution and then cleaned in a chip cleaning system where brushes are used to scrub the opposing sides of the casino chips. It will be understood, that surfaces other than those of casino chips can also be cleaned by combining a pre-soak with a brush scrubbing, thus a tile counter top is a kitchen or bath can have grooves or other indentations in which soils can accumulate thus requiring cleaning using such a pre-soak/scubbing method as has been described.

It will be understood that in addition to accumulations of lighter soils, the term heavily soiled or contaminated is also meant to imply soils caused by urine, grease, grape juice, chocolate, wine and the like on fabrics such as garments, carpets or rugs. That is to say, soils or contaminants that typically require the use of special "spot remover" formulations as are currently known. However, the cleaning solution of the present invention does not typically require such "spot remover" formulations to provide a clean surface or material as some embodiments of the present invention are formulated for use in removing spots of such heavy soils. It should also be noted that where the cleaning solution of the present invention is used in the manner of a previously known "spot remover", no "white ring" as often seen after use of previously known "spot removers" is observed. Hence, the heavy soil or contaminant is incorporated into the cleaning solution or sequestered and removed rather than spread out. Thus to remove such heavily soiled areas from garments, carpets or rugs, a solution in accordance with embodiments of the present solution is applied to the heavily soiled area. In some cases the solution is applied by spraying, while in other cases the solution can be applied as a pre-soak in a container, regardless of the method employed, once wetted the solution is allowed to remain wet for a few minutes before blotting/rubbing with a clean cloth or the like. Typically even the heaviest soils will be removed in this manner, however, if required a second cleaning treatment can be employed.

As previously mentioned, the cleaning solution embodiments of the present invention also exhibit malodor removal properties. Thus, it has advantageously been found that when employed to clean malodorous soils and contaminants, that the malodor is removed with the soil. For example, a carpet or rug stained with animal urine is advantageously cleaned using the cleaning solution of the present invention as a spray. The soiled area is lightly sprayed to wet the soiled area, and subsequently blotted/rubbed with a clean cloth, or the like. After removal of the soil, the area is again lightly wetted with a spray of the cleaning solution of the present invention and allowed to dry without additional blotting/rubbing. Upon drying, the malodor is eliminated.

In addition to eliminating malodors with soils, it has advantageously been found that embodiments of the present invention can be employed to clean air handling systems of mold or fungus growths and thus the often accompanying musty odor. Thus, in some embodiments of the present invention, while the fan of an air handling system is running at maximum speed, a fine spray or aerosol of the cleaning solution of the present invention is sprayed into the air intake. In this manner the aerosol is distributed throughout the air handling system's ducts or channels. As the cleaning solution of the present invention encapsulates a mold or fungus preventing any continued growth, the malodor is eliminated. Thus it has been found that for the common Aspergillus niger spore, the total recovery rate of spores from a sample treated with the "full strength" solution of the present invention was less than 1.5%, where 100% recovery was defined as the number of spores recovered from a sample treated only with sterial deionized water.

In addition to its action to suppress the growth of micro-organisms such as the fungus Aspergillus niger, the cleaning solution of the present invention also exhibits activity against a wide variety of other micro-organisms. For example, application of embodiments of the present invention to surfaces also act as a bactericide, eliminating some viable bacteria on contact essentially all the remaining bacteria upon drying as a film or thin coating. This result is believed to result, at least in part, from the encapusating properties of the film or coating that is formed on drying. In some embodiments of the present invention, a second application of the cleaning solution is made to the cleaned surface and allowed to dry, as described above. It has been found that where such a second application is made, the regrowth of micro-organisms, for example, bacteria and fungi on the treated surface can be extended. The film or coating fprmed upon drying is a hard, lubricious coating that has been found to be between approximately 2 to 10 microns thick. It is believed that the active agents, within the cleaning solution of the present invention, combine to form an encapsulant that prevents the growth of micro-organisms and also provides an active surface to continue to eliminate malodors and prevent re-soiling as well. The presence and effectiveness of this film against re-soiling can be demonstrated by placing a drop of motor oil on each of two dry-wall sections painted with common interior latex paint. When one dry-wall section has been previously cleaned with the cleaning soultion, in accordance with the present invention, the motor oil remains as a droplet and when wiped away with cold water, leaves no residue. In contrast, on the untreated dry-wall section the motor oil spreads on contact and leaves a visible residue when wiped away.

It should be apparant that a general purpose cleaning solution has been described that encompasses only three common, readily available components. It should also be apparant that the cleaning solution of the present invention can be formulated in a variety of concentrations so as to be able to provide cleaning for a wide variety of surfaces and materials. In addition, it should be apparant that as each of the components of the cleaning solution are safe and essentially non-toxic material, that the mixture of these three components is also safe and essentially non-toxic.

Additionally, it should be apparant that the cleaning solution of the present invention has sequestering properties that enable it to clean a wide variety of organic materials and anti-soil and anti-stain properties by and through the thin film or coating formed on drying. It should also be apparant that embodiments of the present invention possess fungicidal and bactericidal properties that are extend by and through the formation of the thin film on drying. In addition, the coating essentially seals the surface cleaned increasing the lubricity thus estending the time between cleaning and the material's useful life due to decreased wear. Finally, it should be apparant that some embodiments of the present invention are useful to reduce or eliminate malodors without the need for additional agents or additives.

The above-described embodiments of the present invention are merely meant to be illustrative and not limiting. It will thus be obvious to those skilled in the art that various changes and modifications may be made without departing from this invention in its broader aspects. Thus while only two specific dilutions in addition to the "full-strength" solution are discussed, it should be realized that any number of dilutuins can be formulated fro the "full-strength" solutions prepared and having a solids concentration of between approximately 2.46 to 2.75%. Therefore, the appended claims encompass all such changes and modifications as fall within the true spirit and scope of this invention.

What is claimed is:

1. A cleaning solution consisting essentially of:

sodium bicarbonate;

sodium carbonate; and trisodium phosphate in an aqueous solution;

wherein a total concentration of the sodium bicarbonate, sodium carbonate and trisodium phosphate, having a molar ratio of approximately 1 to 2.6 to 1.6, respectively, is less than approximately 2.75 percent.

2. The cleaning solution of claim 1 wherein the total concentration is less than approximately 1.7 percent.

3. The cleaning solution of claim 1 wherein said cleaning solution is formulated by first dissolving the appropriate amount of sodium bicarbonate in an appropriate amount of water, next adding the appropriate amount of sodium carbonate and finally adding the appropriate amount of trisodium phosphate.

4. The cleaning solution of claim 1 wherein the aqueous solution consists essentially of deionized water.

5. The cleaning solution of claim 1 wherein the aqueous solution consists essentially of chemically softened water.

6. The cleaning solution of claim 1 wherein the aqueous solution consists essentially of reverse osmosis processed water.

* * * * *